United States Patent [19]

Hanson et al.

[11] 4,373,729

[45] Feb. 15, 1983

[54] PUZZLE WITH ROTATABLE BLOCKS AND FACE PORTIONS SLIDABLE THEREBETWEEN

[75] Inventors: Steven P. Hanson, Rancho Palos Verdes, Calif.; Jeffrey D. Breslow, Highland Park, Ill.

[73] Assignee: Marvin Glass & Associates, Chicago, Ill.

[21] Appl. No.: 224,466

[22] Filed: Jan. 12, 1981

[51] Int. Cl.[3] ..... A63F 9/08

[52] U.S. Cl. ..... 273/153 S

[58] Field of Search ..... 273/153 S, 155, 281; 40/403, 406; 434/174, 206, 402

[56] References Cited

U.S. PATENT DOCUMENTS

| | | | |
|---|---|---|---|
| 743,015 | 11/1903 | Mowry | 273/153 S |
| 785,665 | 3/1905 | Coe | 273/153 S |
| 1,703,159 | 2/1929 | Monheim | 273/155 |
| 2,476,194 | 7/1949 | Hollowell | 273/155 X |
| 2,979,834 | 4/1961 | Giles | 434/174 |
| 3,239,951 | 3/1966 | Benson | 434/174 |
| 3,717,942 | 2/1973 | Presby | 273/155 UX |

*Primary Examiner*—Anton O. Oechsle

*Attorney, Agent, or Firm*—McDermott, Will & Emery

[57] ABSTRACT

A puzzle includes a plurality of elements or blocks stacked end to end and connected together for rotation relative to one another around a common axis. The faces of one or more of the blocks include face portions slidable along the surface of the device from block to block generally along the axis of rotation of said blocks. One block includes an "open" face without a movable face portion so that the face portions can be redistributed around the device by rotating the blocks around their common axis and sliding the face portions from one block to another. The face portions bear indicia indicating a predetermined arrangement so that beginning with a device having its face portions randomly distributed around the device, the device is manipulated to rearrange the face portions into the predetermined order.

10 Claims, 4 Drawing Figures

PUZZLE WITH ROTATABLE BLOCKS AND FACE PORTIONS SLIDABLE THEREBETWEEN

BACKGROUND OF THE INVENTION

1. Field of the Invention

This invention relates generally to puzzles and more particularly to puzzles having interfitting pieces capable of only limited relative motion.

2. Description of the Prior Art

In the past puzzles have taken a wide variety of forms. Puzzles having pieces connected together for limited relative motion to position those pieces in a predetermined arrangement are known. One such device, known as Rubik's Cube, commercially distributed by Ideal Corporation, takes the form of a cube having a plurality of portions rotatable with respect to one another around a common axis, each of these portions also being a part of a plurality of perpendicularly arranged portions rotatable around a common axis perpendicular to the first axis of rotation. The user rotates the portions around the axes to rearrange the portions in a predetermined order to solve the puzzle.

SUMMARY OF THE INVENTION

Many objects and advantages of the present invention are achieved by a game device including at least two blocks, each having at least three sides. The blocks are rotatably connected together at one side for rotation relative to one another around an axis normal to said sides. A plurality of face portions are slidably retained on the sides of the blocks for sliding movement from one block to another in a direction generally parallel to the axis of rotation of said blocks.

DESCRIPTION OF THE PREFERRED EMBODIMENT

Figure 1:
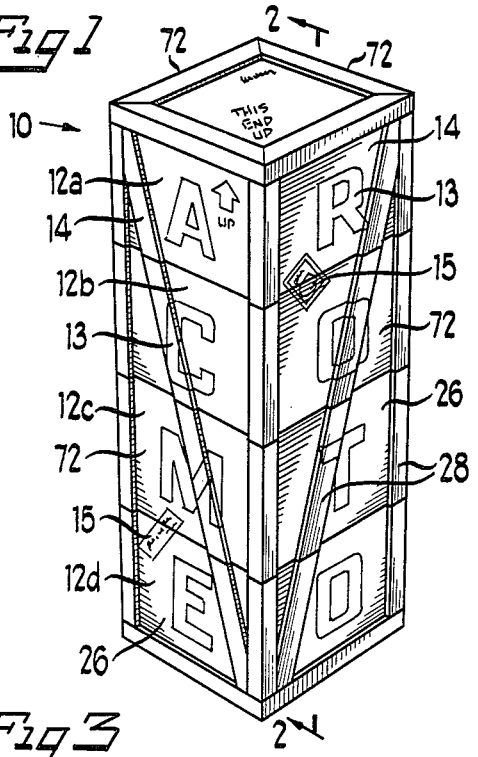
FIG. 1 is a perspective view of one embodiment of the present invention.

Referring to the drawing wherein like reference characters are used for like parts throughout, there is illustrated in FIG. 1 a puzzle game device 10, conveniently having the appearance of a stack of crates or the like, including a plurality of stacked interconnected blocks 12 with sliding face portions 14 covering their outwardly directed sides. The face portions 14 of the device 10 are adorned with means to distinguish each portion 14 from all the others. In the embodiment illustrated, a letter indicia 13 is displayed on each portion 14, so that words are formed, such as "ACME" and "ROTO" when the blocks 12 are appropriately arranged. Alternatively, the portions 14 could bear the letters of the alphabet or numbers arranged in increasing order from the top of the device to its bottom making possible an educational utility. However, any visually or tactilely recognizable pattern can be used on the portions 14. In addition, various other indicia 15 commonly printed on shipping crates are included on the portions 14 for added realism in accordance with the stacked crates theme.

Figure 4:
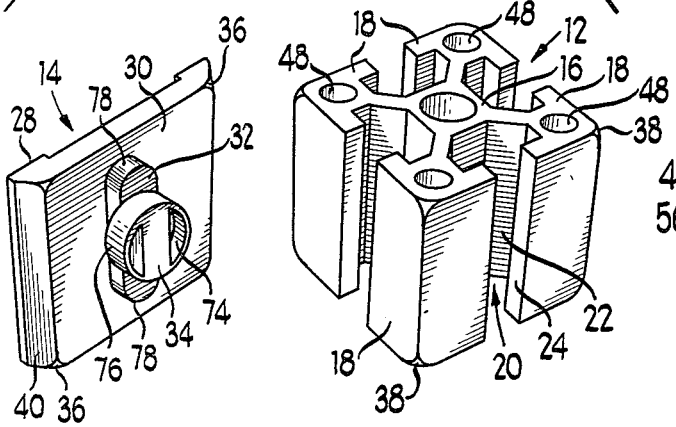
FIG. 4 is an exploded perspective view of one of the blocks and a slideable face portion forming the device shown in FIG. 1.

As shown in the perspective view of FIG. 4, each block 12 has a generally X-shaped cross-section with a cored out central portion 16 connecting a set of four outwardly directed arrow-shaped portions 18, spaced from one another by approximately 90 degrees. Each set of two adjacent arrow-shaped portions 18 form a keyed slot 20 having an enlarged or widened interior base 22 and a narrow exterior portion 24. An aperture 48 may be provided through each arrow-shaped portion 18 to decrease the weight and reduce the amount of material required.

Figure 3:
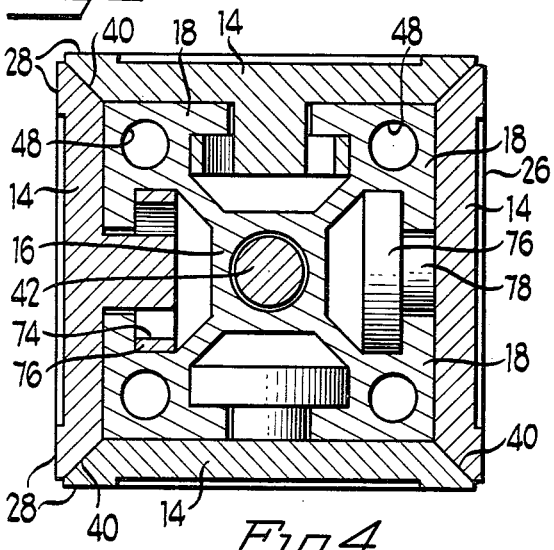
FIG. 3 is a cross-sectional view taken generally along the line 3—3 in FIG. 2.

The face portions 14 are arranged to slide within the keyed slot 20 to each block 12. Each face portion 14 includes an exterior surface 26 having an appearance similar to the side of a crate, conveniently including imitation support boards or other raised distinguishing means 28. The interior surface 30 of each face portion 14 includes an oval-shaped outwardly directed land 32 with curved ends 78 and a circular disc 34 connected centrally on the end of the land 32. The oval land 32 is of a width to freely slide within the narrow exterior portion 24 of keyed slot 20 while the disc 34 is of sufficient size to slide within the widened interior base portion 22 of keyed slot 20. The widened configuration of the disc 34 prevents the disc from leaving the keyed slot 20. Conveniently, the interior corners 36 of the face portion 14 are rounded and the corners 38 of block 12 are likewise rounded. As shown in FIG. 3, the edges 40 of the face portions 14 are preferably cut at an angle of 45° so that adjacent face portions 14 on the same block 12 form a flush fit at the corners of each block 12.

As shown in FIG. 4, the disc 34 may have a pair of hollowed out regions 74 forming a resilient outer ring 76 which functions as a spring, with the ring 76 resiliently biased between the adjacent arrow-shaped portions 18. This spring action may cause the face portions 14 to be snugly held within keyed slots 20, as shown in the cut-away in FIG. 2 so that they do not freely and randomly slide within the slot 20 but instead are only repositioned by positive displacement by the user.

Figure 2:
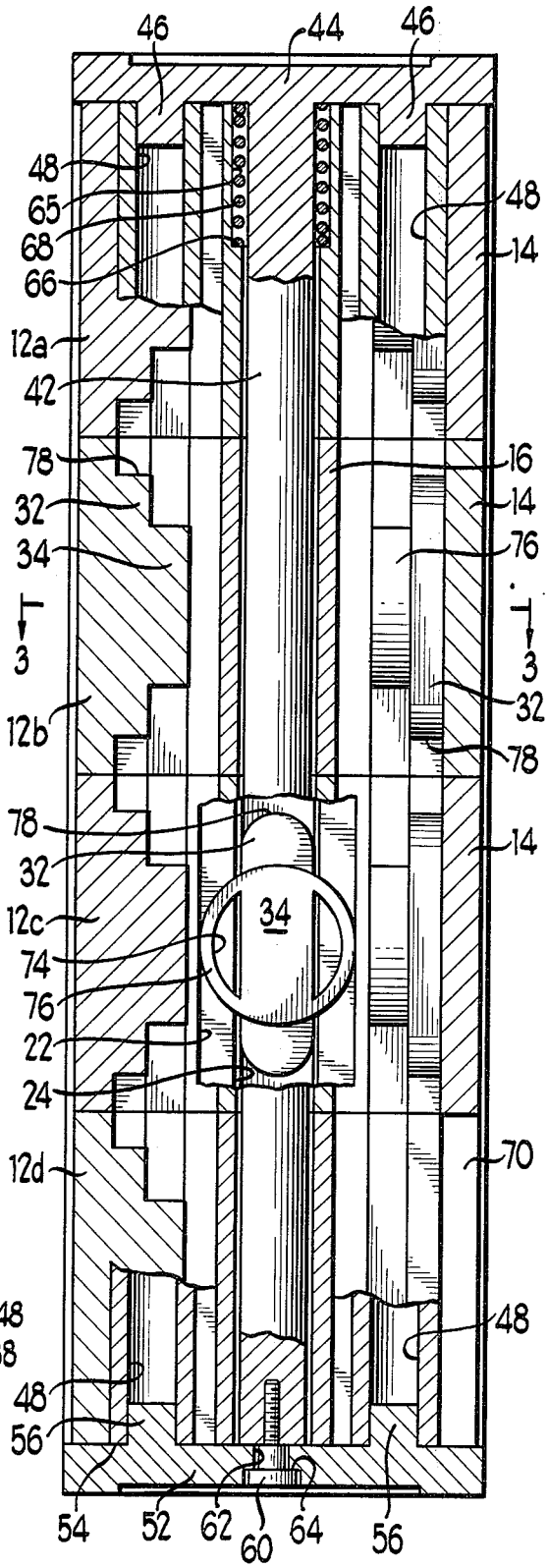
FIG. 2 is an enlarged, cut-away, cross-sectional view taken generally along the line 2—2 in FIG. 1.

As shown in FIG. 2, the blocks 12 are connected by a central shaft 42 that extends through the cored out central portion 16 of each block 12. The shaft 42 includes a widened end 44 which forms the top of the device 10, conveniently having an external appearance similar to the top of a wooden crate. The widened end 44 also includes a set of four downwardly directed pins 46 which engage apertures 48 in the uppermost block **12*a*. An end plate 52 having an exterior appearance similar to that of the exterior of the widened end 44 covers the end surface 54 of the lowermost block 12*d*. The end plate 52 includes a set of four upwardly directed pins 56 which engage the apertures 48 in the block 12*d*. The shaft 42 is connected centrally to the end plate 52 by a shoulder bolt 60 which threads into the end of the shaft 42 and is retained in a counterbored hole 62 in end plate 52. Thus the shoulder 64 of shoulder bolt 60 secures the end plate 52 to the shaft 42, while allowing relative rotation between the shaft 42 and plate 52**.

The uppermost block **12*a* has a counterbore 65 and a land 66 formed in one end of its cored out central portion 16 to receive a spring 68 retained in the counterbore 65 between the land 66 and the widened end 44 of central shaft 42, encircling the central shaft 42. The spring 68 biases the blocks 12 together against the end plate 52 providing sufficient friction between the blocks 12 to prevent the various blocks 12** from rotating freely and at random.

Preferably, a sliding face portion 14 is provided for each of the four slots 20 in each block 12 except for one block 12 that has only three face portions 14 to provide an open space 70, shown in FIG. 2. The open space 70 allows the other face portions 14 to slide vertically along the length of the device 10 parallel to the length of shaft 42. In addition, the blocks 12 may be rotated relative to one another around shaft 42 so that the open space 70 can be positioned on any side 72 of the device 10, simply by rotating the block 12 having the open space 70. The rotation of one or more blocks 12 relative to the other blocks 12 is accomplished by manually grasping the block or blocks to be rotated with one hand while retaining the other blocks 12 in the other hand.

The device is operated by randomly distributing the face portions 14 around the periphery of the device 10 and requiring the user to manipulate the device 10 to arrange the face portions 14 in a desired or predetermined arrangement governed by the indicia 13. The face portions 14 are redistributed around the device 10 by rotating the blocks 12 relative to one another around the shaft 42 and sliding the face portions 14 along the surface of the device 10 parallel to the length of the shaft 42 from block 12 to block 12 into the one available open space 70. Although rotation of the block 12*a* relative to the other blocks with one hand causes rotation of the shaft 42 due to the action of pins 46, this rotation is not transmitted to any of the other blocks 12 when those blocks are retained by the user's other hand. This is because as the block 12*a* is rotated, the end of the shaft 42 rotates relative to the end plate 52 which is held stationary by maintaining the block 12*d* stationary. Thus the shaft 42 threads and unthreads on shoulder bolt 60 without requiring rotation of any of the blocks 12 other than the block 12*a*. Similarly the rotation of the block 12*d* is not transmitted to the other blocks because of the sliding connection between the shaft 42 and the end plate 52.

The rounded corners 38 of blocks 12 and the internal corners 36 of the face portions 14 enable the face portions 14 to automatically align themselves with their blocks 12 as the blocks 12 are rotated relative to one another. In addition, the curved ends 78 of the lands 32 align the blocks 12 with one another as a face portion 14 is slid from block to block in the slots 20.

Many modifications and variations of the present invention are possible in light of the above teaching. Thus, it is to be understood that, within the scope of the appended claims, the invention may be practiced otherwise than as specifically described above.

What is claimed and desired to be secured by Letters Patent of the United States is:

1. A game device comprising:

a plurality of blocks each having a plurality of sides and a pair of opposed ends, at least two of said blocks being rotatable with respect to a third block, said blocks being connected together in a columnar array with their ends in abutment, for relative rotation around a common axis;

a plurality of face portions slidably retained on the sides of said blocks for sliding movement from one block to another in a direction generally parallel to said common axis, the number of face portions being one less than the number of block sides, to permit movement of said face portions parallel to said common axis from one block to another;

means for preventing sliding movement of said face portions around said common axis, with respect to the block upon which said face portions are mounted; and indicia means on each of said face portions for distinguishing said face portions from one another and defining a predetermined arrangement of said face portions on said device in order to implement a game wherein a player attempts to arrange the face portions in the desired arrangement by rotating said blocks with respect to one another and sliding said face portions from one block to another.

2. The game device of claim 1 wherein said blocks form a rectangular solid, said solid having a central shaft upon which said blocks rotate relative to one another.

3. The game device of claim 2 wherein each of said blocks has a keyed slot aligned with a slot in the other blocks, said face portions having an outwardly extending tab slidably retained within said slot for movement from one block to another.

4. The game device of claim 3 wherein said outwardly extending tab on said face portion includes a resilient disc.

5. The game device of claim 4 wherein said disc is biased against the walls of said slot by spring action.

6. The game device of claim 5 including means for preventing rotation of said face portions relative to said block.

7. The game device of claim 2, including a pair of opposed end surfaces and a side surface, said side surface being formed from four face portions slidably secured to each of said blocks except one, said one block having only three of said face portions so as to form an open space for sliding movement of said face portions along the side surface of said device.

8. The game device of claim 7 including a pair of end plates covering said end surfaces, said blocks retained between said end plates and biased together by spring action.

9. The game device of claim 7 including four blocks, arranged in an end-to-end stack, the outer two blocks of said stack being rotatable relative to the inner two blocks.

10. The game device of claim 9 wherein said inner two blocks are rotatable with respect to one another.

* * * * *